United States Patent [19]

Edmunds

[11] Patent Number: 4,501,326

[45] Date of Patent: Feb. 26, 1985

[54] IN-SITU RECOVERY OF VISCOUS HYDROCARBONACEOUS CRUDE OIL

[75] Inventor: Neil R. Edmunds, Calgary, Canada

[73] Assignee: Gulf Canada Limited, Toronto, Canada

[21] Appl. No.: 458,517

[22] Filed: Jan. 17, 1983

[51] Int. Cl.[3] ..... E21B 43/24

[52] U.S. Cl. ..... 166/272; 166/50; 166/271

[58] Field of Search ..... 166/272, 266, 267, 303, 166/245, 271, 50

[56] References Cited

U.S. PATENT DOCUMENTS

| | | | |
|---|---|---|---|
| 2,876,838 | 3/1959 | Williams | 166/272 X |
| 2,974,937 | 3/1961 | Kiel | 166/272 X |
| 3,269,460 | 8/1966 | Hardy et al. | 166/274 |
| 3,685,581 | 8/1972 | Hess et al. | 166/272 |
| 3,838,738 | 10/1974 | Redford et al. | 166/272 X |
| 3,960,213 | 6/1976 | Striegler | 166/272 |
| 4,109,718 | 8/1978 | Burton | 166/266 X |
| 4,119,149 | 10/1978 | Wu et al. | 166/272 X |
| 4,174,752 | 11/1979 | Slater et al. | 166/272 X |
| 4,344,485 | 8/1982 | Butler | 166/272 X |

*Primary Examiner*—Stephen J. Novosad
*Attorney, Agent, or Firm*—R. H. Saunders

[57] ABSTRACT

A process for recovering heavy hydrocarbonaceous oil in situ is disclosed. After a communication path is established between injection and production wells, a hot viscous fluid at least 20% of which is produced hydrocarbonaceous oil from the production well is circulated between the wells providing high sweep efficiency and good recovery of oil in place. In a preferred embodiment, the fluid comprises recirculated bitumen from the production well, steam, and small amounts of inert gas and emulsified water. The final stage is a recovery by conventional means.

21 Claims, 6 Drawing Figures

IN-SITU RECOVERY OF VISCOUS HYDROCARBONACEOUS CRUDE OIL

Figure 1:
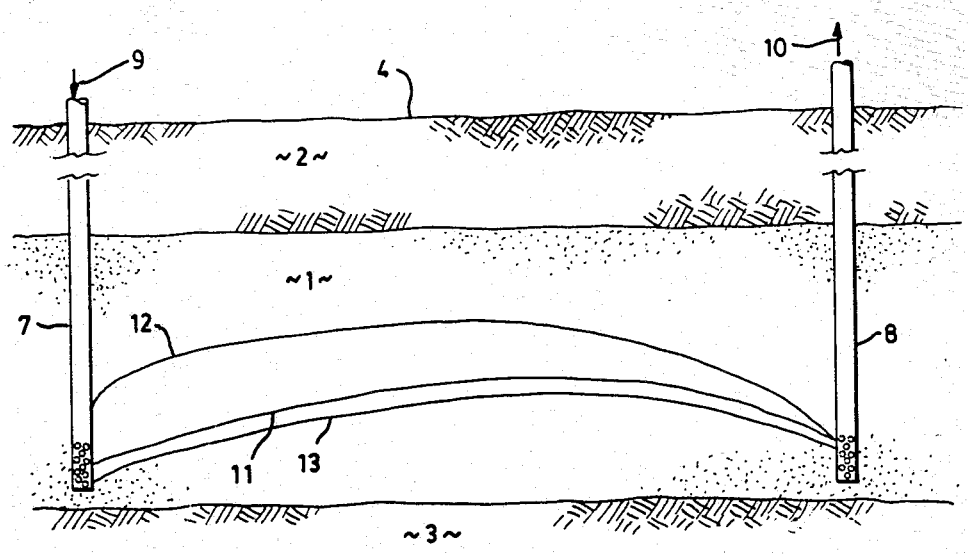

This invention relates to an improvement in the recovery of viscous hydrocarbonaceous oil from a subterranean formation. More specifically, it relates to the use of viscous fluids to provide heat to the bitumen in a formation prior to the recovery of the bitumen through a production well.

In many subterranean formations containing crude oil, the oil is highly viscous and difficult or impossible to produce by conventional methods. Such oil, known as heavy oil or bitumen, is found, for example, in the Lloydminster and Athabasca deposits in Canada, and in the Orinoco deposit in Venezuela. Some deposits are sufficiently near the surface that they can be recovered by surface mining, but other deposits are uneconomic to surface mine because of the large amount of overburden. In-situ methods known in the art of recovering deep viscous crude oil are generally directed to reducing the viscosity of the bitumen to improve its willingness to flow to a production well, or in combination with viscosity reduction, to driving the bitumen towards a production well by providing an appropriate pressure gradient and flow path. The heat can be provided by a heated fluid; hot water, steam of quality from zero to 100%, superheated steam and hot solvents are known in the art. The typical result using steam is that the steam, being less dense than bitumen, overrides the bitumen in the formation and produces a narrow communication path between wells with only a very slow heat transfer to the formation, and consequently achieves only limited recovery. Liquid water does not displace bitumen effectively and also develops only a narrow communication path and poor recovery. One attempt to overcome this problem was disclosed by Spillette in U.S. Pat. No. 3,447,510, in which steam and cold water were injected alternately to maintain a uniformly nearly vertical heat front. A method disclosed by Gomaa in U.S. Pat. No. 4,093,027 was to adjust the steam quality in order to provide a vertical heat profile and thus optimize the energy efficiency. Also known in connection with enhanced recovery of conventional oil is the use of polymers to increase the viscosity of the aqueous driving fluid. Other methods in the prior art include reducing the viscosity of the bitumen by introducing non-condensible gases under pressure, and injecting hot solvent to partially mix with the bitumen and reduce its viscosity.

The invention overcomes these and other problems by providing a method for improving the recovery of viscous hydrocarbonaceous oil from a subterranean formation penetration by at least one injection well and at least one production well, said wells being in fluid communication with said formation, comprising:

(a) establishing a heated communication path between said injection and production wells, in a communication development step, (b) injecting heated viscous fluid into said injection well, in a recirculation step, until a suitable portion of said subterranean formation is heated, and (c) recovering hydrocarbonaceous oil from said formation, in a recovery step, at least substantially 20% by mass of said heated viscous fluid being viscous hydrocarbonaceous oil produced from said production well.

Figure 2:
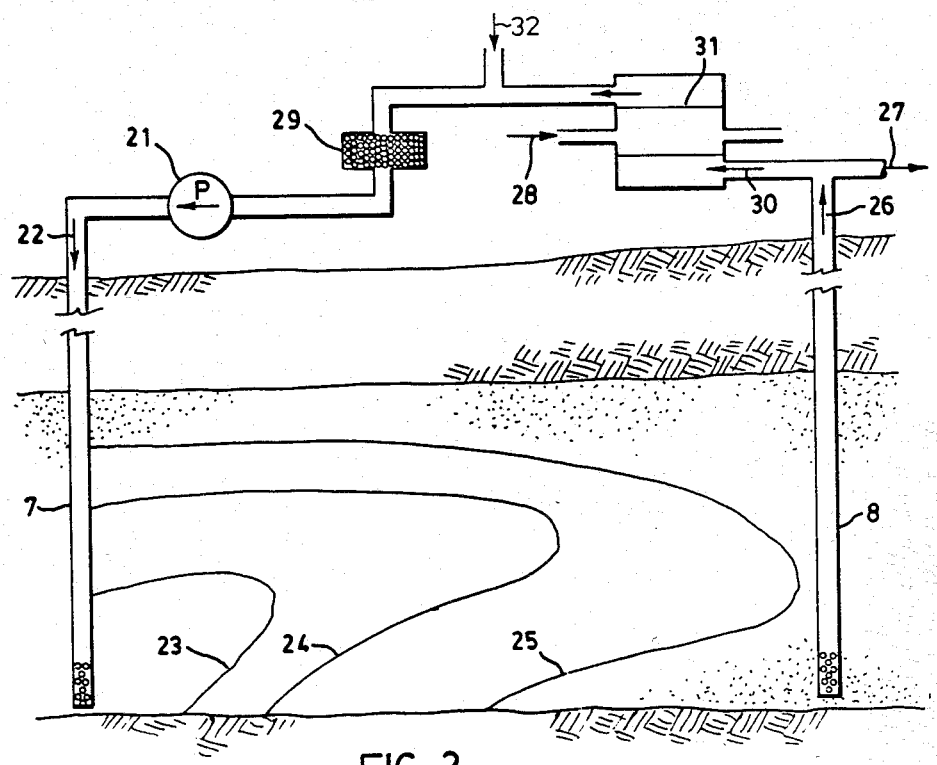
Figure 3:
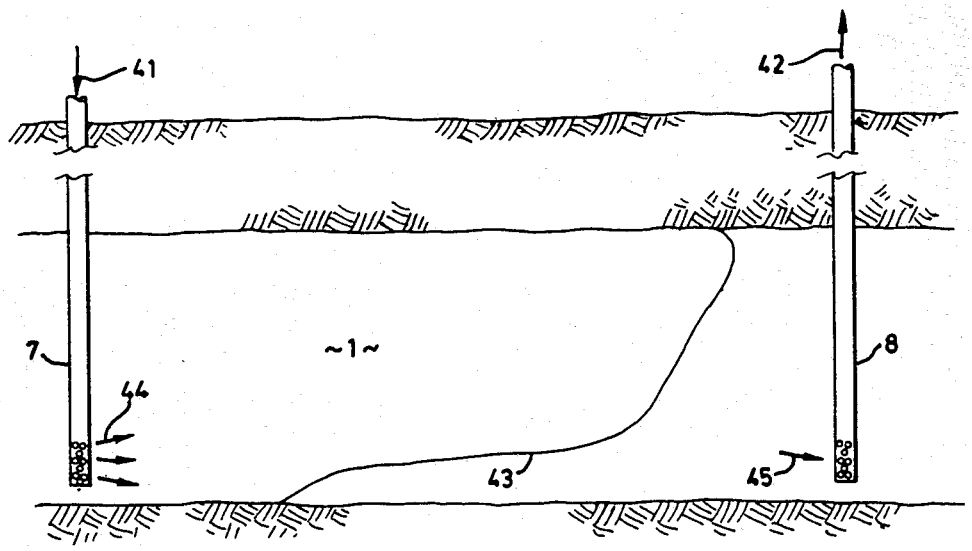
Figure 4:
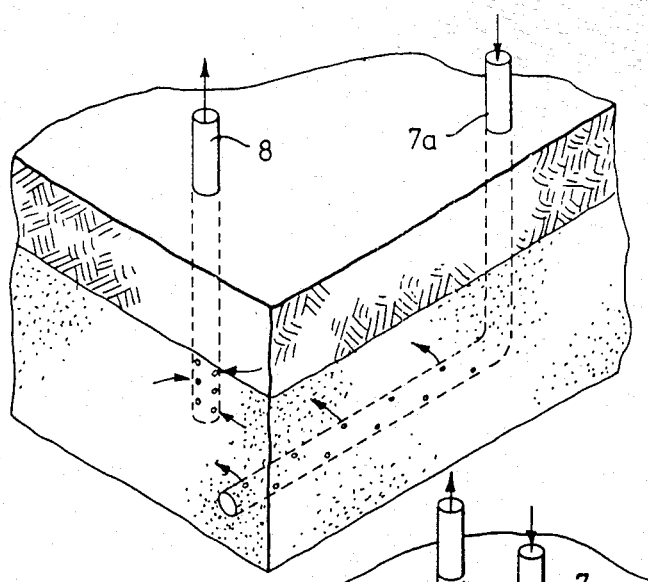
Figure 5:
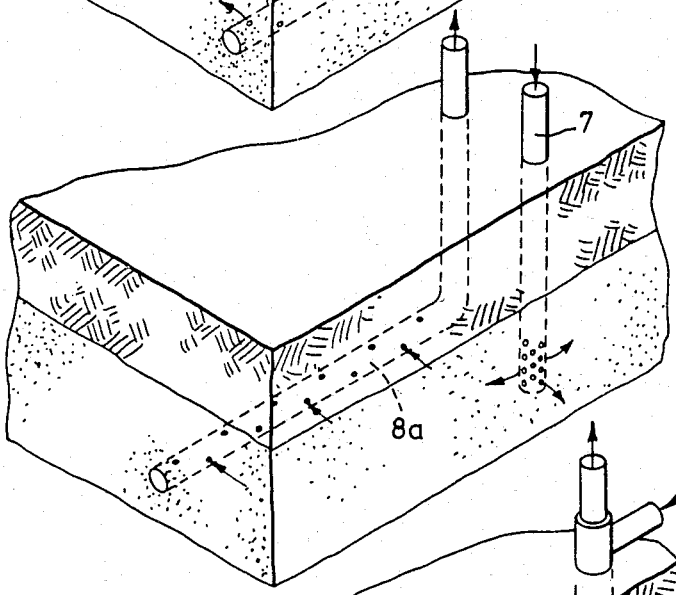
Figure 6:
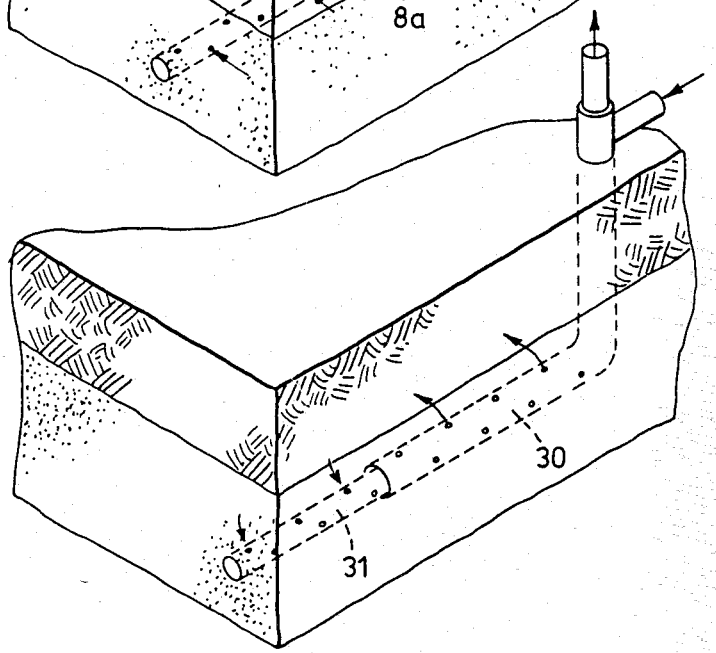

In drawings which illustrate a preferred embodiment of the invention,

FIG. 1 shows a petroleum-bearing formation after establishment of a heated communication path, FIG. 2 shows the formation during the fluids recirculation step, and together with apparatus to recirculate the preferred viscous fluid, FIG. 3 illustrates the formation during the recovery step, and FIGS. 4, 5 and 6 illustrate in perspective alternative well configurations by which injection and production can be effected.

In this specification all references to percentages are by volume and all gas volumes are at standard conditions, i.e. 15° C. and 101.325 kPa, unless otherwise indicated.

In practising the invention to recover bitumen from a reservoir containing oil sand, the first step is to establish a communication path between the injection and production wells. FIG. 1 illustrates a preferred embodiment showing a petroleum-bearing formation in vertical cross-section after the communication development step. Overburden 2 and petroleum-bearing formation 1 are penetrated by injection well 7 and production well 8 extending from above ground surface 4. The wells are plugged near the top of underlying layer 3. Initial path 11 can be a fracture, a thin water sand, horizontal well or other permeable path. A fracture can be prepared by conventional methods, for example, by using fracturing fluids. Advantageously, a fracture can be produced by steam injection. In this invention, a long and tortuous path 11 between injection and production wells is advantageous because it provides an improved heat transfer into the reservoir fluids compared to a short, straight path. The temperature of the formation adjacent the path 11 is raised to a level sufficiently high that fluid injected in a subsequent step does not cool excessively and plug the communication path and prevent injection of further fluid. Heat transfer fluid 9, comprising water or light hydrocarbons, for example methane, or hydrogen sulphide, or steam is injected to accomplish the temperature rise. Steam is preferred because of its high heat capacity, while both water and steam exhibit a desirable low viscosity at reservoir temperature. Fluids of high viscosity at reservoir temperature are avoided at this stage because they tend to plug the communication path. Soon after steam injection has begun, if steam is used, production of cold water 10 at the production well 8 begins. In this specification, "production" means "discharge at the surface of fluid flowing from a well". As steam injection continues, the heat front moves through the formation towards the production well. During this period, cold water is produced.

When the heat front reaches the production well 8, the temperature of the produced water 10 rises rapidly and significant amounts of bitumen are produced, indicating the presence of sufficient heat in the communication path. The steam-containing zone at breakthrough extends between upper boundary 12 and lower boundary 13. Optionally, the preheating step can be continued after initial breakthrough of heated bitumen to the production well, whereby a volume portion up to about 30% and preferably 10 to 15% of the bitumen in place is produced prior to commencing a recirculation step.

When communication is established, a recirculation step is begun. In the general case, a heated viscous fluid comprising bitumen produced from a production well or wells associated with the injection well, and having a viscosity from 1 to 100 centipoises at 200° C. is introduced into the injection well. It is essential that the injected viscous fluid either be capable of being processed with the produced bitumen in further process steps, for example viscosity reduction or hydrocracking, or be readily separable from the bitumen. Reheated bitumen from the production well advantageously comprises a major portion of the injected fluid, and preferably the entire amount of the injected fluid, excluding additives discussed hereinafter.

FIG. 2 shows the injection of preferred viscous fluid 22, which comprises in major portion reheated filtered bitumen from production well 8. The injection pressure at the bottom of the injection well 7 must be kept below the fracture pressure. This limitation operates primarily in the early stages of the recirculation phase, during the time that the cross-sectional area through which heated bitumen flows is low and flow-related pressure drop is high; the cross-sectional area increases as bitumen is ablated, i.e. heated in the sand in the formation and entrained into the flowing fluid, allowing an increased flow rate for a given bottom-hole injection pressure; during the later stages the capacity of injection pump 21 can become the limiting factor in fluid flow. Thermal expansion in the reservoir usually causes more fluid 26 to be produced than is injected, causing net production 27 of fluid during the recirculation phase, up to a value of about 8% of the oil in the swept volume, if the injected fluid is essentially bitumen. Optionally, a small amount of inert gas, for example carbon dioxide or nitrogen, can be injected with the bitumen, up to about 1.0 $m^3/m^3$ of bitumen, or 50% of the injected fluid by volume (at standard conditions) which will further displace bitumen in the formation, increasing the net production by about 5 to 10% of the oil in the swept volume depending on the specific bitumen being recovered. The increase in displacement of bitumen by means of the gas inclusion can be greater than the critical gas saturation in parts of the reservoir, especially near the top because of gravity drainage.

Optionally, the net production can be enhanced by including up to 2 parts of steam per 5 parts bitumen by mass and/or emulsifying up to 50% water into the injected bitumen, either alone or in combination with injection of an inert gas. Up to 50% atmospheric or vacuum residuum and/or up to 2% non-degrading polymeric materials, for example polyacrylate, can be added to the injected fluid if desired to raise its viscosity towards the upper limit of 100 cP at 200° C. The maximum allowable viscosity of the recirculating fluid entering the production well 8, which is at a lower temperature than the injection well 7, is about 500 cP. Optionally, some of the bitumen to be injected can be reduced, that is treated to remove some of the lighter components, if it is originally whole bitumen. These measures, which can also be carried out in combination, have the effect of increasing the viscosity of the injected material and hence increasing its sweep efficiency. The additives can be incorporated prior to filtration in filter 29 as, for example, additive material 32, or after filtration or prior to heating in the heat exchanger, as appropriate to the material being added. The minimum proportion of recirculated bitumen in the injected fluid is about 20% by mass. The emulsion produced using steam or water in the recirculating bitumen has a viscosity and a heat capacity greater than those of bitumen alone and is maintained oil-external, that is, having oil as the continuous phase; if the emulsion becomes water-external its viscosity and thus its effectiveness in the present process decrease markedly. The emulsion usually remains oil-external when up to 50%, the maximum water content depending upon, for example, the specific bitumen being recirculated and the presence of surface active agents. Water in excess of that which is emulsified probably exists as free water. In practice, the amount of steam, water and other additives can be increased to the point where the viscosity of the driving fluid mixture begins to fall off; this point is detected when the injection well pressure falls off at the desired fluid flow rate. Dry bitumen passing through a formation may absorb much of the connate water which is present in undisturbed bitumen formations, thereby making separation of bitumen from the sand matrix more difficult. This problem can be prevented in the present process by optionally incorporating up to 10% free water in the injected fluid. When steam is injected in the communication development step or added in the recirculation step, its salinity and pH are controlled to avoid permeability damage especially in the vicinity of the injection well, where the flow per unit area is the largest of any area in the formation.

Prior to re-injection, the produced fluids 30 can be filtered in filter 29. Filtering is a normal procedure with injection wells of all kinds, in order to prevent clogging of the formation by solids in the injection fluid. The produced fluids to be recirculated in practising the invention contain fine clays and coarser solids which tend both to abrade and to clog the injection system as well as to clog the formation if not filtered out.

The produced fluids 30 to be re-injected are reheated to a temperature between 100° C. and 300° C., preferably between 180° and 250° C. The lower limit is related to the requirement of putting into the formation as much heat as possible, in as short a time as possible. There are offsetting factors: the lower temperature causes a desirable higher viscosity in the injected fluid, up to a maximum of about 100 cP at the injection temperature, but at the same time reduces its heat supplying capability. The upper temperature limit is governed primarily by the potential of the bitumen in the fluids to degrade over the long term to coke and light hydrocarbons. Degradation is undesirable because the resulting coke can abrade the injection system and clog the formation and because degraded bitumen is less viscous than virgin bitumen. Low-temperature, long-term degradation is an important consideration because the recirculation phase continues in most operations for a long period, from about one half year to four years. Reheating is preferably accomplished in heat exchanger 31 by heat transfer with a heat transfer fluid 28, preferably steam. Direct heat transfer from combustion gases is possible but entails the risk of inducing premature degradation because of hot spots in the heat exchanger. Certain additives can advantageously be blended with the injected bitumen to improve its long-term stability. For example, pH control agents affect the emulsification properties of the bitumen and also its interaction with clays present in the reservoir. It is also advantageous to remove coke to prevent its becoming concentrated in the recirculating fluid.

While the recirculation step is proceeding, the progress of the heat front represented by isotherms 23, 24, and 25, is tracked by comparing the injection and production temperatures, doing material and heat balances, and by using tracers in the injected fluid. Such techniques are well-known in the art, with respect to injection of other hot fluids.

The recirculation step is continued until an appropriate amount of heating has taken place in the formation fluids. It is not necessary to heat thoroughly all of the bitumen in the reservoir during the recirculation step, because further heat is supplied during the recovery step by means of the steam pumped into the reservoir in order to displace the bitumen, which heat is capable of mobilizing most of the bitumen not heated during the recirculation step. Accordingly, it is preferable to supply during the recirculation step at least about 50% of the amount of heat needed to heat all of the bitumen in place to the temperature of the injected fluid.

FIG. 3 shows a reservoir during the recovery stage of the process. Conventional recovery techniques are employed; for example, cold water at low pressure can be injected which flashes to steam in the reservoir and achieves adequate recovery; it is preferable to inject steam, however, because of higher ultimate recovery and higher pressure capability. In a typical recovery, steam 41 is injected into injection well 7 and flows into the formation 1 in flow pattern 44, producing steam front 43. Bitumen/water mixture 45 flows into production well 8 and is recovered at the surface as produced fluids stream 42. Alternatively, forward combustion can be used to drive the heated bitumen to the production well.

The invention will be further described with reference to the following examples, which illustrate a preferred embodiment.

EXAMPLES 1-2

A numerical simulation was done using a computerized finite-difference analysis model. Using parallel horizontal wells 100 m long and 50 m apart, 1.9 meters above the bottom of the pay zone, a two-dimensional model was capable of evaluating gravitational and propagation effects. A homogeneous McMurray oil sands type of reservoir was assumed, having 80% oil saturation, a connate water saturation of 20%, a critical gas saturation of 5% and porosity of 35%. The bitumen-bearing pay zone in the formation was 30 m thick, horizontal permeability 3.3 darcies and vertical permeability 1.6 darcies. Maximum injector bottom hole pressure was 7000 kPa, while producer bottom hole pressure was a minimum of 3500 kPa. Maximum recirculation rate, limited by pump capacity, was assumed to be 1000 $m^3$/day per injection well. A fracture was assumed to be induced that rose vertically above the wells and crossed the pay zone at its topmost level. During the communication development step, steam at 7000 kPa and 80% quality was injected at 301 $m^3$/day (cold water equivalent) for 100 days. In the recirculation step, bitumen was injected for 630 days in Example 1 and 302 days in Example 2, as shown in Table 1, a mixture of bitumen at 460 $m^3$/day and water at 0.9 $m^3$/day being used at a temperature of 250° C. The recovery step followed, with a duration adjusted for approximately equal bitumen recovery in the two Examples.

TABLE 1

RECOVERY OF BITUMEN IN-SITU

| | Example 1 | Example 2 |
|---|---|---|
| Recirculation: | | |
| Duration, days | 630 | 302 |
| Average bitumen production rate, $m^3$/day | 466 | 468 |

TABLE 1-continued

RECOVERY OF BITUMEN IN-SITU

| | Example 1 | Example 2 |
|---|---|---|
| Average net bitumen production rate, $m^3$/day | 4.8 | 6.2 |
| Recovery: | | |
| Duration, days | 94 | 302 |
| Average steam injection rate, $m^3$/day | 204 | 167 |
| Average bitumen production rate, $m^3$/day | 287 | 97 |
| Overall: | | |
| Well life, days, including communication development step | 824 | 704 |
| Net energy injected, Terajoules | 142 | 171 |
| Average net bitumen production rate, $m^3$/day | 37 | 45 |
| Recovery, % Original Oil in Place | 72 | 75 |

EXAMPLE 3

A further numerical simulation was done assuming the same reservoir as in Examples 1 and 2, but placing horizontal wells 13.2 m above the bottom of the pay zone and assuming that a horizontal fracture was made directly between the two wells. This straight horizontal fracture at mid-depth of the formation and the fracture climbing vertically to and across the top of the reservoir represent the probable extremes of fracture behaviour. Actual reservoirs generally fracture in an intermediate pattern. In the communication development step, steam at 7000 kPa and 80% quality was injected at 293 $m^3$/day (cold water equivalent) for 100 days. A mixture of 424 $m^3$ bitumen, 0.8 $m^3$ water and 170 $m^3$ nitrogen, at 230° C., was injected daily for 900 days. Results were as indicated in Table 2.

TABLE 2

RECOVERY OF BITUMEN FOLLOWING HORIZONTAL FRACTURE

| | Example 3 |
|---|---|
| Recirculation: | |
| Duration, days | 900 |
| Average bitumen production rate, $m^3$/day | 433 |
| Average net bitumen producton rate, $m^3$/day | 7.8 |
| Recovery: | |
| Duration, days | 200 |
| Average steam injection rate, $m^3$/day | 303 |
| Average bitumen production rate, $m^3$/day | 213 |
| Overall: | |
| Well life, days, including communication development step | 1200 |
| Net energy injected, Terajoules | 269 |
| Average net bitumen production rate, $m^3$/day | 42 |
| Recovery, % Original Oil in Place | 60 |

Example 1 indicates the energy efficiency of an extended recirculation stage using the viscous bitumen, compared to Example 2 wherein the recirculation step was shorter but the recovery step much longer. In Example 1, 4% less of the original oil in place was recovered, but 17% less energy was consumed in the process. For the purpose of calculating net injected energy in all Examples, 100% of heat produced during communication development and recovery steps, was assumed to be recovered. Example 3 demonstrates that the method of the invention is applicable to short, horizontal fractures as well as to the tortuous fractures of Examples 1 and 2.

By providing continuous injection of heated viscous fluid, the method of the invention minimizes override and channelling of the injection fluid, because the specific gravity and viscosity of heated bitumen are much closer to those of the bitumen in the formation than are the specific gravity and viscosity of steam. Ablation, i.e. wearing away or frictional removal, of bitumen is improved because the viscosity of the recirculating fluid is about 70 times the viscosity of water at the temperatures used in the process.

The process of the invention can be carried out with a single or a plurality of injection wells combined with one or a plurality of production wells. A preferred combination is a seven-spot multiple well pattern, in which each injection well is surrounded by six equally-spaced production wells, the ratio of injection to production wells being related to the ratio of injectivity to productivity in the reservoir. Other factors relevant to well spacing in the process of the invention include the fracturing pressure; the ability to produce a fracture communicating well-to-well; the maximum allowable pressure at the injection well bottom during the circulation and recovery steps, which is related to and lower than the fracturing pressure; the bottom hole pressure at the production wells which can be lowered by pumping produced fluids to the surface; and the time necessary to develop a communication path from well to well. Methods for the determination of these factors are known to persons skilled in the art. The injection and production wells can be vertical, angled or horizontal or any combination thereof, and the injection well need not be at the same angle as the production well. FIG. 4 shows horizontal injection well *7a* and vertical production well 8, and FIG. 5 illustrates vertical injection well 7 together with horizontal production well 8*a*. When a horizontal well is employed a portion 30 of the well can be completed as an injection well and a second portion 31 completed as a production well as shown in FIG. 6, by methods known in the art. For example, concentric tubing strings within the casing can be used for injection and for production portions of the well.

The process of the invention is operable with thin water sands present in a formation. During the communication development stage, the presence of thin water sands can be advantageous, because they are susceptible to relatively easy development of a communication path from an injection well to a production well without the need to fracture the formation. Thick water sands present the problem, however, that the water can continue to be displaced almost indefinitely by injected fluids, making injection of bitumen uneconomic.

The process of the invention is advantageous for the recovery of crude oils whose viscosity is 500 centipoises or greater at initial reservoir conditions. It is well adapted to recover, for example, Lloydminster crude, various grades of which have viscosities from about 500 to about 10 000 cP, and Athabasca crude, usually called bitumen, whose viscosity is in the area of $1\times10^6$ cP. An advantage of the method is the fact that the bitumen heat front during the circulation stage sweeps around shale lenses more efficiently than a gravity-driven steam front. This is particularly useful in a reservoir which does not have a vertically continuous pay zone.

What is claimed is:

1. A method for improving the recovery of viscous hydrocarbonaceous oil from a subterranean formation penetrated by at least one injection well and at least one production well, said wells being in fluid communication with said formation, comprising:

(a) establishing a heated communication path between said injection and production wells, in a communication development step, (b) injecting heated fluid having a viscosity of at least one centipoise at 200° C. into said injection well, in a recirculation step, until a suitable portion of said subterranean formation is heated, said heated fluid being heated to a temperature from substantially 100° C. to 300° C. before being injected, and (c) recovering produced hydrocarbonaceous oil from said formation, in a recovery step, at least substantially 20% by mass of said heated fluid being viscous hydrocarbonaceous oil produced from said production well.

2. A method as claimed in claim 1 wherein said viscous fluid has an absolute viscosity at 200° C. from substantially 1 centipoise to substantially 100 cP.

3. A method as claimed in claim 1 wherein said heated viscous fluid is heated to a temperature from substantially 180° C. to substantially 250° C. before being injected.

4. A method as claimed in claim 1 wherein said viscous hydrocarbonaceous oil has a viscosity at least substantially 500 cP, measured at 20° C.

5. A method as claimed in claim 1 wherein said heated viscous fluid consists essentially of viscous hydrocarbonaceous oil produced from said production well.

6. A method as claimed in claim 1, wherein said produced oil is heated by absorbing heat from a heat transfer fluid.

7. A method as claimed in claim 6 wherein said heat transfer fluid is steam.

8. A method as claimed in claim 1 wherein said viscous fluid comprises steam, the mass ratio of said steam to said viscous oil portion of said viscous fluid being no more than 2:5 by weight.

9. A method as claimed in claim 1 wherein said viscous fluid comprises no more than substantially 50% water by volume emulsified in said fluid.

10. A method as claimed in claim 1, wherein said viscous fluid comprises no more than 10% free water by volume.

11. A method as claimed in claim 1 wherein said viscous fluid comprises reduced bitumen.

12. A method as claimed in claim 1 wherein said viscous fluid comprises no more than substantially 2% polymeric viscosity-raising material by volume.

13. A method as claimed in claim 1 wherein said viscous fluid comprises no more than substantially 50% inert gas by volume, expressed at standard conditions.

14. A method as claimed in claim 1 wherein said viscous fluid comprises no more than 50% residuum from distillation of crude oil.

15. A method as claimed in claim 1 wherein said viscous fluid is injected for a period from substantially one half to substantially four years.

16. A method as claimed in claim 1 wherein the amount of heat transferred to the reservoir during injection of said viscous fluid is at least substantially 50% of the heat necessary to heat all of the bitumen in place to the temperature of the viscous fluid entering said injection well.

17. A method as claimed in claim 1 wherein said injection and production wells are vertical.

18. A method as claimed in claim 1 wherein said injection and production wells are horizontal.

19. A method as claimed in claim 1 wherein said injection well is vertical and said production well is horizontal.

20. A method as claimed in claim 1 wherein said injection well is horizontal and said production well is vertical.

21. A method as claimed in claim 1 wherein said injection well and said production well are completed as two portions of a substantially horizontal well.

* * * * *